US005257568A

United States Patent [19]

Nitschmann

[11] Patent Number: 5,257,568

[45] Date of Patent: Nov. 2, 1993

[54] SAW CHAIN

[75] Inventor: Karl Nitschmann, Schorndorf, Fed. Rep. of Germany

[73] Assignee: Andreas Stihl, Waiblingen, Fed. Rep. of Germany

[21] Appl. No.: 968,176

[22] Filed: Oct. 29, 1992

[30] Foreign Application Priority Data

Oct. 30, 1991 [DE] Fed. Rep. of Germany ..... 4135734
Oct. 2, 1992 [DE] Fed. Rep. of Germany ..... 4233176

[51] Int. Cl.[5] ..... B27B 33/14
[52] U.S. Cl. ..... 83/830; 83/151
[58] Field of Search ..... 83/830, 831, 832, 833, 83/834, 151; 125/21

[56] References Cited

U.S. PATENT DOCUMENTS 2,749,950 6/1956 Jamieson et al. ..... 83/831
3,366,150 1/1968 Malloff ..... 83/833
4,353,277 10/1982 Silvon ..... 83/833
4,567,803 2/1986 Anderson ..... 83/834 X
4,756,221 7/1988 Nitschmann et al. ..... 83/830 X
4,873,903 10/1989 Harfst ..... 83/830

*Primary Examiner*—Frank T. Yost
*Assistant Examiner*—Rinaldi Rada
*Attorney, Agent, or Firm*—Walter Ottesen

[57] ABSTRACT

The invention is directed to a saw chain for a motor-driven chain saw equipped with a guide bar and a drive motor for imparting a force to the saw chain for moving the latter around the guide bar in a predetermined running direction. The saw chain includes a plurality of side cutting links, a plurality of center driving links and a plurality of side connecting links. The links are pivotally interconnected by rivets to define the saw chain. Entrainers are formed on at least a portion of the connecting links and/or drive links to reliably hold a chip cut by a forward cutting tooth in the free space between two cutting links one directly behind the other. The chip is therefore prevented from slipping relative to the saw chain and is transported out of the kerf without affecting the cutting capacity of the next-rearward cutting link.

23 Claims, 6 Drawing Sheets

SAW CHAIN

FIELD OF THE INVENTION

The invention relates to a saw chain for a motor-driven chain saw.

BACKGROUND OF THE INVENTION

Known saw chains include center drive links which define a chain together with laterally arranged connecting links and cutting links. The drive links, connecting links and cutting links are pivotally connected one to the other by rivets. The cutting edges of the cutting links define a cutting plane. The edges of the other chain links facing toward the cutting plane determine approximately a limiting plane of the chain. The free space lying between the cutting plane and the limiting plane acts to receive the chips. The chips enter the free space during operation of the saw chain in order to be moved in the running direction with the saw chain and out of the kerf.

A plurality of cutting links is arranged over the length of the saw chain to achieve a high cutting capacity. The cutting links are spaced with respect to each other viewed in the running direction and this spacing corresponds approximately to the length of two connecting links. For this reason, it can happen in practice that a chip cut by a forward cutting link slips through and disturbs the cutting action of the cutting link which trails behind the forward cutting link. A reduction in cutting capacity can result.

SUMMARY OF THE INVENTION

It is an object of the invention to provide a saw chain for a motor-driven chain saw which is so improved that the full cutting capacity is available even under unfavorable operating conditions.

The saw chain of the invention is for a motor-driven chain saw equipped with a guide bar and a drive motor for imparting a force to the saw chain for moving the latter around the guide bar in a predetermined running direction U. The saw chain includes: a plurality of side cutting links, a plurality of center driving links and a plurality of side connecting links, the links being pivotally interconnected by rivets to define the saw chain; the rivets lying transversely to the running direction U; each of the cutting links having a cutting tooth extending above the connecting links and the drive links; the cutting tooth having a cutting edge disposed above the saw chain and lying transversely to the running direction U; the cutting edges of corresponding ones of the cutting links disposed one behind the other conjointly defining a cutting plane; the drive links and the connecting links having upper edges facing toward the cutting plane; at least some of the upper edges defining a limiting plane at a spacing (a) below the cutting plane; the cutting plane and the limiting plane conjointly defining a free space for receiving and transporting cut chips from the kerf; entraining means formed on at least several ones of the upper edges for engaging and holding cut chips in the free space; and, the entraining means being at a spacing (b) from the cutting plane for every operating position of the saw chain.

At least several of the chain links have at least one entrainer at their edge facing toward the cutting plane. For this reason, a chip cut by a forward cutting tooth is reliably held in the free space between two cutting links one directly behind the other and is therefore prevented from slipping relative to the saw chain to the next rearward cutting tooth thereby affecting its cutting capacity In this way, the chips collect in the free space between two mutually adjacent cutting links so that the chips are transported by the saw chain out of the kerf. Even under unfavorable operating conditions, the condition is prevented that a cut chip persists in the kerf; that is, a larger relative movement in the longitudinal direction of the chain occurs between the cut chip and the saw chain. The cut chip is held so as to move with the saw chain in this embodiment of the invention.

According to another embodiment of the invention, the entire edge is provided with entrainers arranged one behind the other when viewed in the running direction of the saw chain. For obtaining a simple assembly, it is advantageous to configure the entrainers to be uniform so that (at least with respect to the side links) it is irrelevant on what side of the saw chain the links having these entrainers are mounted during assembly. However, it can be advantageous to configure the entrainers so as to have increasing elevation in a direction opposite to the running direction of the saw chain whereby the free space is narrowed in the direction opposite to the movement of the chain. In this way, the chips are prevented from slipping through to the next-rearward cutting tooth. This effect can be increased by inclining the entrainers in the direction of movement.

In a preferred embodiment, the edges of all side-connecting links have entrainers whereby a simple assembly is ensured. All center drive links can have entrainers on their respective edges facing toward the cutting plane.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
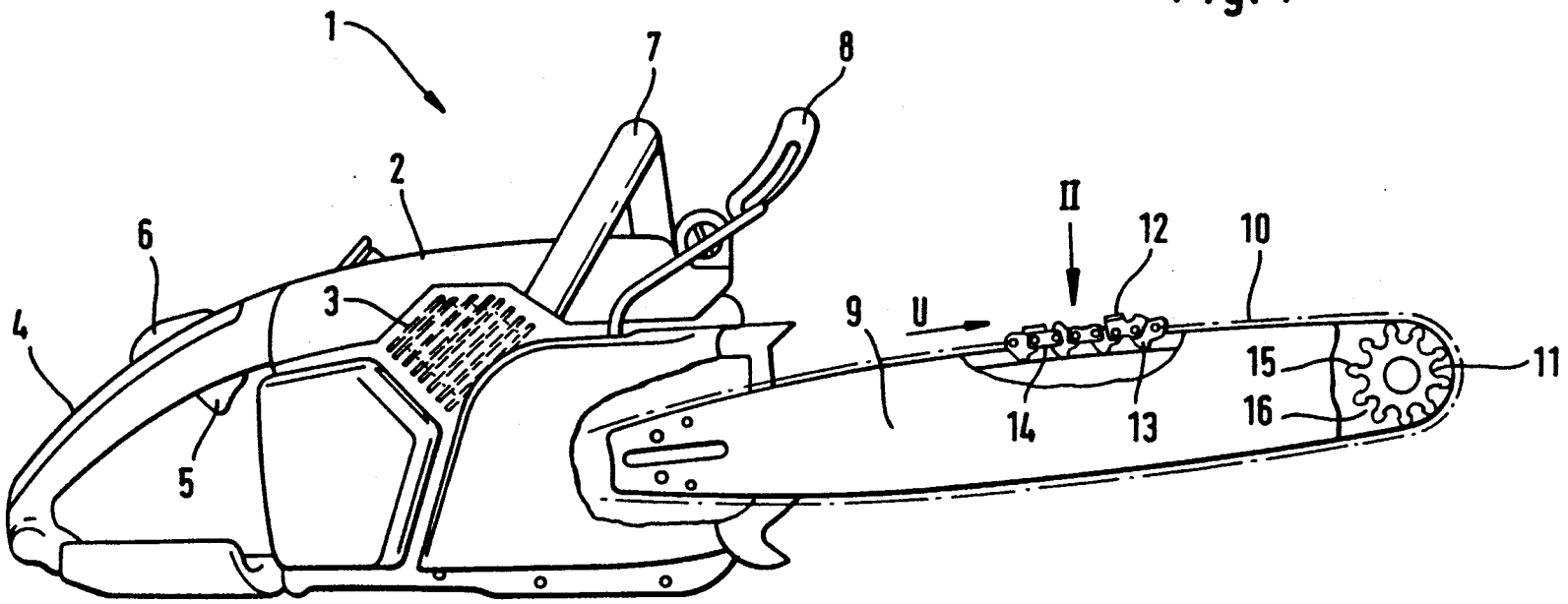
FIG. 1 is a schematic side view of a motor-driven chain saw having a saw chain according to the invention.

The motor-driven chain saw 1 shown schematically in FIG. 1 includes a housing 2 having a drive motor 3 which is an internal combustion engine in the embodiment shown. The engine can be especially a two-stroke engine. An electric motor can likewise be advantageous. The housing 2 carries a rearward handle 4 directed in the longitudinal direction of the chain saw and a throttle lever 5 and a throttle latch 6 are mounted in this handle. In addition, a forward bail handle 7 is provided and lies transversely to the longitudinal direction of the chain saw. A handguard 8 is mounted forward of the handle 7. A guide bar 9 extends forwardly from the housing 2 in the longitudinal direction of the chain saw. A continuous saw chain 10 is guided on the guide bar and is driven by the drive motor 3 in the running direction U of the chain. A nose sprocket 11 is provided for the saw chain 10 on the forward end of the guide bar 9 for changing the direction of movement of the saw chain.

As shown especially in FIGS. 2 to 10, the saw chain 10 includes center drive links 13, laterally arranged connecting links 14 and cutting links 12 with the links conjointly defining the chain. The drive links 13 engage into the guide groove of the guide bar 9 with foot portions 26 and are held in the tooth gullets 16 formed between the teeth 15 of the nose sprocket 11. The drive sprocket (not shown) driven by the drive motor (not shown) likewise engages the foot portions 26 of the drive links 13.

All chain links 12, 13 and 14 have two pivot axes 17 lying with a spacing one behind the other in the running direction U of the chain. The pivot axes are defined by rivets 19 which extend through corresponding bores 18 in the chain links and pivotally connect the chain links to each other as shown. The cutting links 12 are disposed alternately on the right and left sides of the chain viewed in the running direction and are configured as side links as are the connecting links 14; whereas, the drive links 13 are center links which are each disposed at one end between two connecting links 14 and between a cutting link 12 and a side link 14 at the other end thereof.

The cutting link 12 extends upwardly to define a cutting tooth in its rearward region when viewed in the running direction U. The cutting tooth extends above the other chain links (13, 14) and is bent over transversely to the base body of the cutting link and has a cutting edge 21 at its forward end. The cutting edge 21 lies transversely to the running direction U above the other chain links 13 and 14 with the cutting tooth 20 being inclined rearwardly starting from the cutting edge 21 whereby a free angle 22 is formed. In order to obtain a high cutting capacity and yet substantially eliminate kickback in combination with the saw chain, the magnitude of the free angle 22 amounts advantageously to approximately 5° to 10° and is approximately 7°.

An upwardly projecting depth limiter 23 is formed on the cutting link 12 on the forward portion thereof viewed in the running direction U. The depth limiter is somewhat inclined relative to the plane of the base body of the cutting link 12 having the bores 18. The depth limiter 23 is positioned forward of the saw tooth 20 viewed in running direction U and is so configured that its rounded forward edge 24 extends up to above the mid region of the drive link 13 in the direction toward the forward pivot axis 17 of the drive link.

The center links 13, the side connecting links 14 and the base body of the cutting link 12 conjointly define the chain which, in turn, defines a limiting plane 25 facing away from the guide bar 9. The limiting plane 25 is determined approximately by the edges 27 and 28 of the side connecting links 14 and/or of the center drive links 13 facing away from the guide bar 9. The limiting plane 25 of the chain lies parallel to the plane 30 defined by the pivot axes 17.

Figure 2:
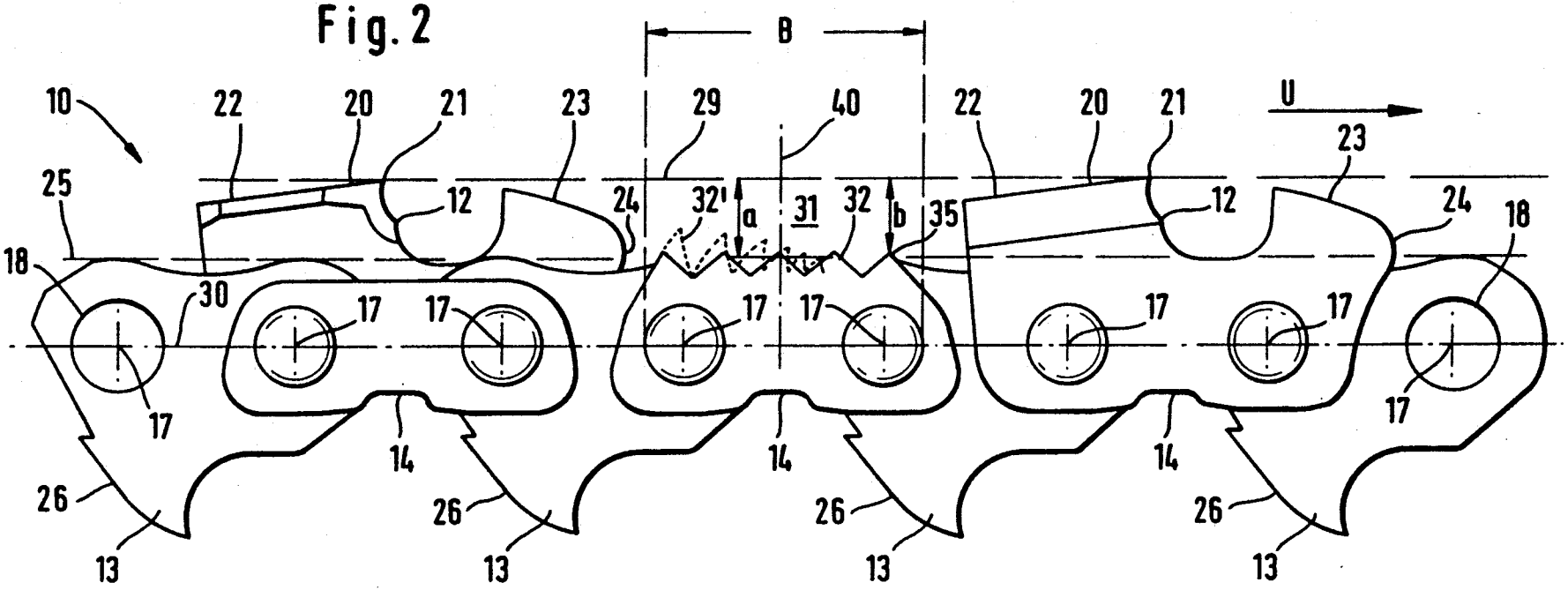
FIG. 2 shows a cutaway portion of an embodiment of the saw chain of the invention.

The cutting edges 21 of the cutting links 12 following one another in the running direction U define a cutting plane 29 which lies at a spacing (a) to the limiting plane 25 of the chain as shown in FIG. 2. The free space 31 lying between the cutting plane 29 and the limiting plane 25 functions to receive cut chips in order to remove the chips from a kerf in the running direction U. The free space 31 is delimited by the side walls of a kerf (not shown) transversely to the running direction U of the saw chain.

Figure 3:
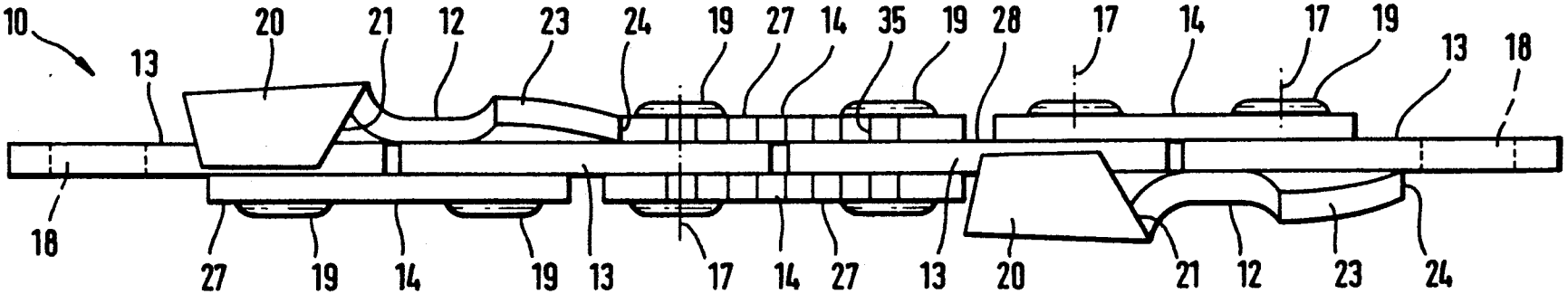
FIG. 3 is a plan view of the saw chain of FIG. 2 viewed in the direction of arrow II in FIG. 1.

In the embodiment of FIGS. 2 and 3, the connecting links 14 lying between two cutting links 12 one behind the other have entrainers 32 at the edge 27 facing toward the cutting plane 29. The entrainers 32 follow each other one behind the other in the running direction U and define a kind of saw tooth configuration over the entire length of the connecting link 14. The entrainers 32 are preferably configured to be each the same and to have pointed teeth. The arrangement is preferably so provided that the entrainer 32 (at least with a portion of its elevation) projects above the limiting plane 25; that is, the entrainer projects into the free space 31. The tip 35 of the entrainer 32 lies at a spacing (b) to the cutting plane 29. The spacing (b) is therefore only slightly less than the spacing (a) of the cutting plane 29 from the limiting plane 25 so that the tip 35 of each entrainer 32 lies essentially in the region of the limiting plane 25. In each operating position of the saw chain 10, a spacing (b) to the cutting plane 29 is provided so that the tip 35 of the entrainer 32 always lies with a clear spacing relative to the base of the kerf, that is, the tip 35 never touches the base of the kerf.

The entrainers 32 afford the advantage that chips entering into the receiving space 31 are held relative to the saw chain 10 in order that these chips be transported away out of the kerf in the running direction U. In this way, chips cut by a forward cutting link 12 do not slip through to the next-following cutting link to affect its cutting function.

In order to maintain a next-following cutting link 12 almost completely free from the cut chips of a next-forward cutting link 12, it can be advantageous to configure the entrainers 32' so that they have increasing height in a direction opposite to the running direction U of the saw chain 10 as shown in phantom outline in FIG. 2. The entrainers 32' can also be inclined in the running direction U.

Figure 4:
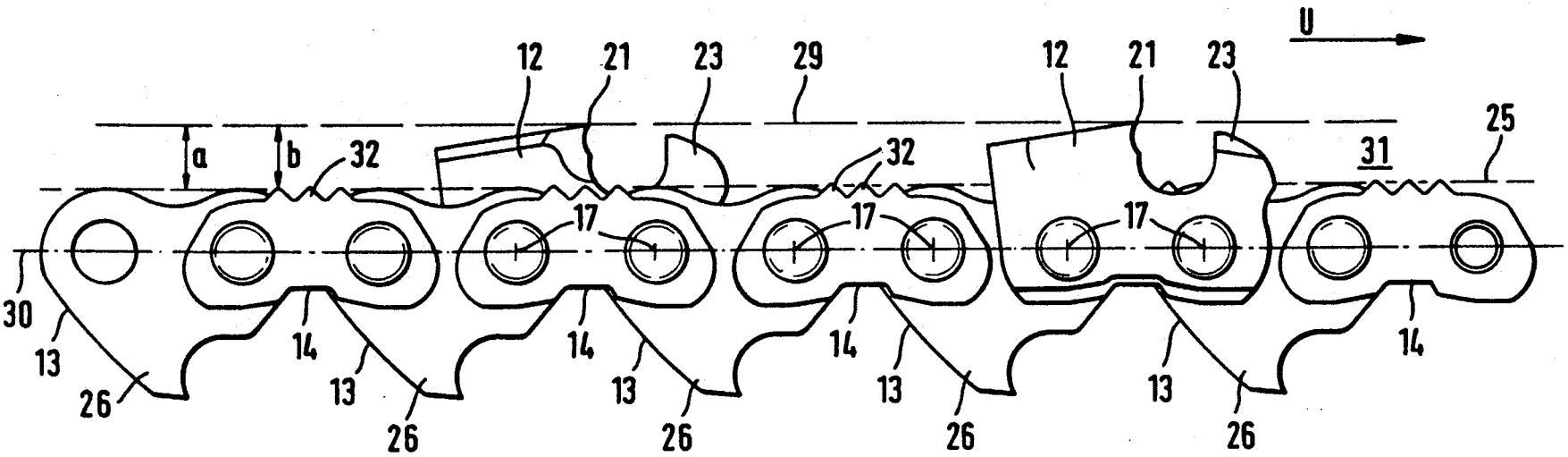
FIG. 4 is a cutaway portion of another embodiment of the saw chain of the invention.
Figure 5:
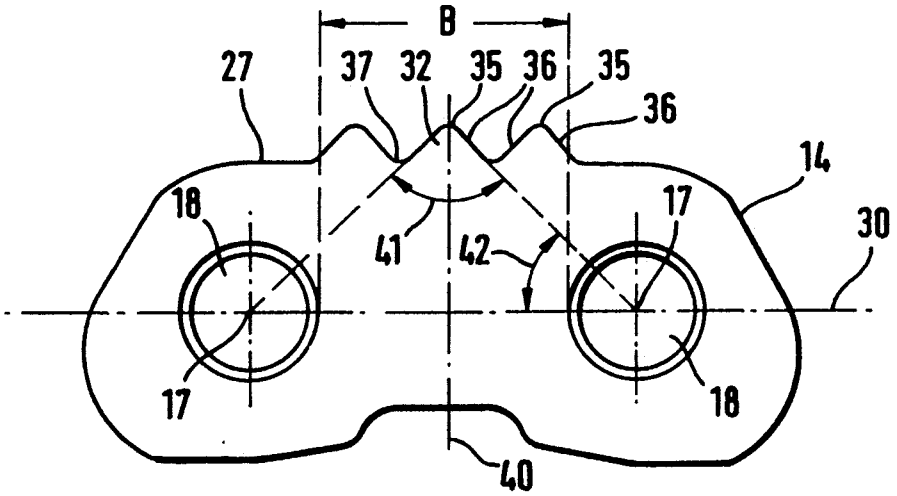
FIG. 5 is an enlarged view of a cutting link of the saw chain of FIG. 4.

In the embodiment of FIGS. 4 and 5, three entrainers 32 are arranged over the length of the connecting link 14 in the manner of a preferably uniform saw-tooth configuration. It can be adequate to provide only one entrainer 32. The uniform saw-tooth configuration shown in FIGS. 4 and 5 extends over a part length B of the connecting link 14. The part length B is determined by the tangents drawn perpendicularly to the plane 30 of the pivot axes 17 with the tangents being on the circular segments of the bores 18 (FIG. 5). The center entrainer 32 has a symmetry axis 40 perpendicular to plane 30 and the symmetry axis 40 precisely divides the space between the two pivot axes 17. The flanks 36 of the entrainer 32 intersect the pivot axes 17 when extended by an imaginary line. The angle 41 defined by the flanks 36 is preferably 90°. The symmetry axis 40 bisects the angle 41. It can be advantageous to slightly round the tips 35 of the entrainers. The flanks 36 of each entrainer each lie at an angle 42 of preferably 45° to the plane 30.

In the embodiment of FIGS. 4 and 5, all side connecting links 14 of the saw chain 10 are provided with at least one entrainer but preferably with three entrainers 32 at their respective edges 27 facing toward the cutting plane 29. The valleys between each two entrainers lie with their root point 37 in the plane defined by the edge 27. The connecting link 14 can be mounted in mirror image since the connecting link 14 has the center symmetry axis 40.

Figure 6:
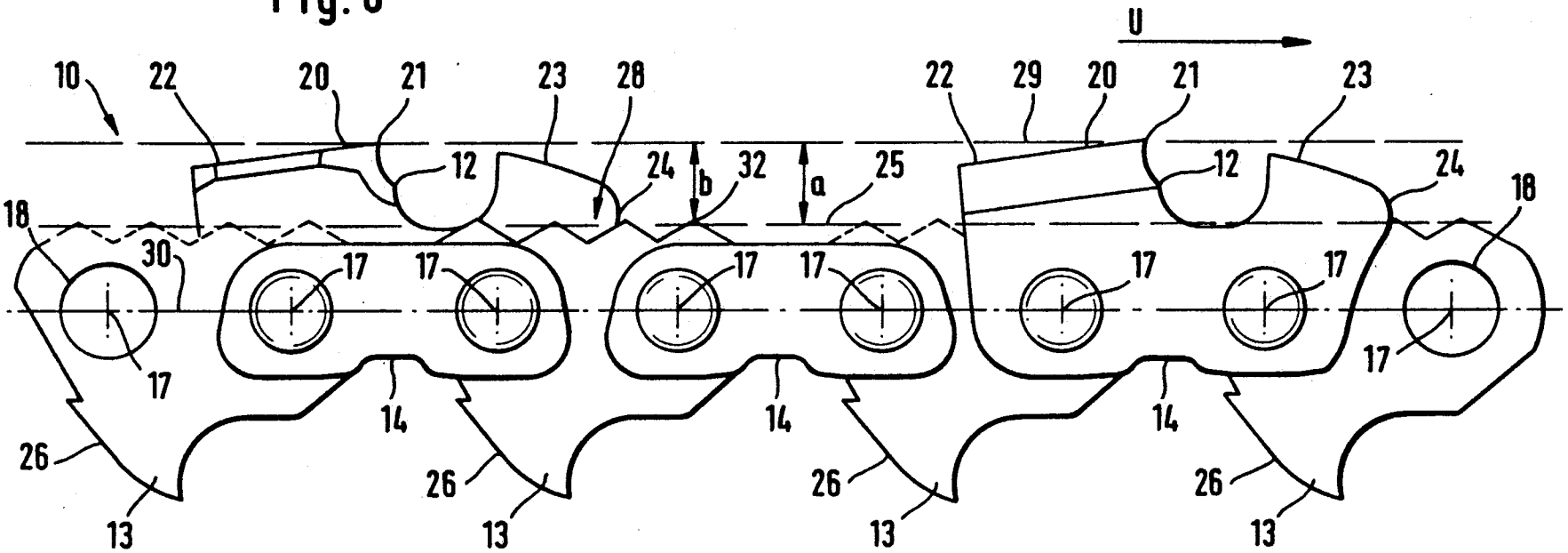
FIG. 6 is a cutaway portion of another embodiment of the saw chain of the invention.
Figure 7:
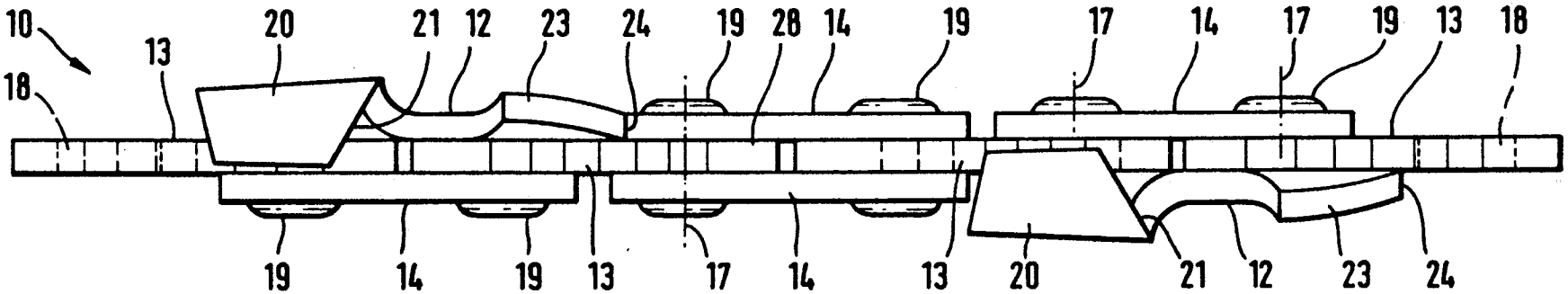
FIG. 7 is a plan view of the saw chain of FIG. 6.

In the embodiment of FIGS. 6 and 7, center drive links 13 are provided with at least one entrainer 32 at their edge 28 facing toward the cutting plane 29. In the embodiment shown, several entrainers 32 in the form of a saw-tooth configuration are provided. The saw-tooth configuration is configured uniformly in the running direction U of the saw chain 10. The entrainers 32 project only slightly above the limiting plane 25.

As seen especially in FIG. 6, the next-forward drive link 13 connected to the cutting link 12 has an entrainer 32 at its edge 28. These entrainers prevent cut chips of the next-forward cutting link 12 from reaching the region of the cutting edge 21 of the next-rearward cutting link 12. The chips are prevented in their relative movement along the saw chain 10 because of the entrainer 32 and especially because of the saw-tooth configuration.

All drive links 13 advantageously have entrainers 32 at their edge 28 facing toward the cutting plane 29 as shown in phantom outline in FIG. 6.

Figure 8:
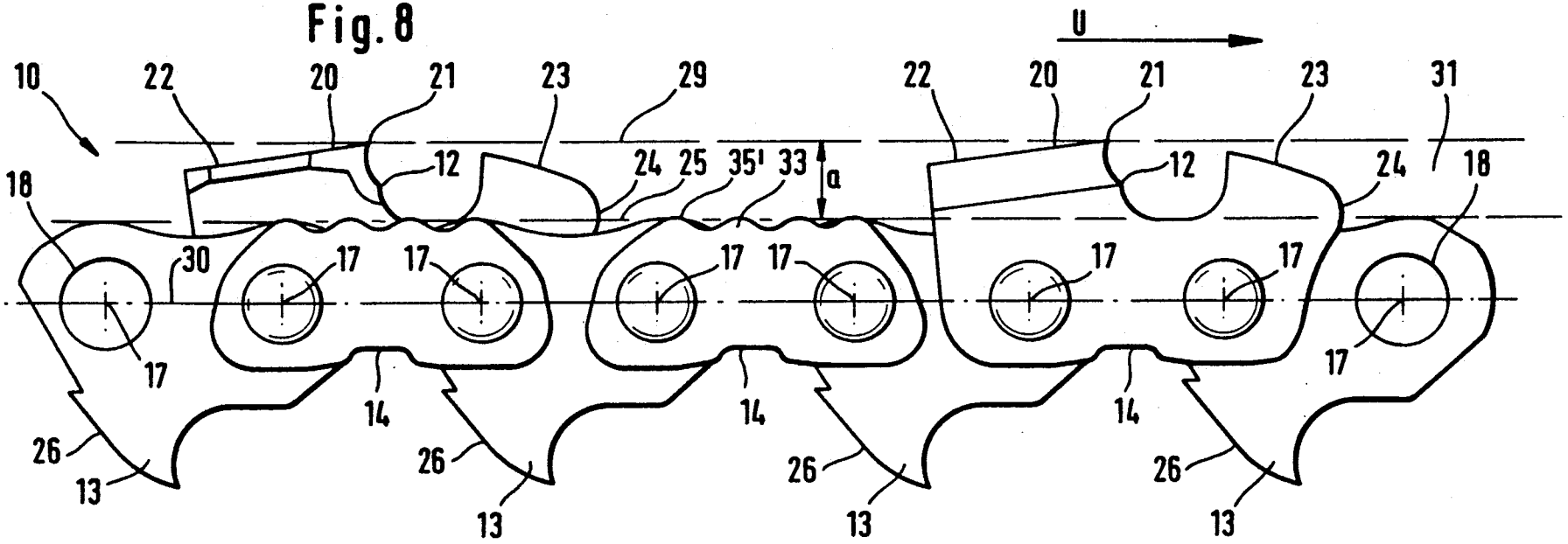
FIG. 8 is a cutaway portion of another embodiment of the saw chain of the invention.
Figure 9:
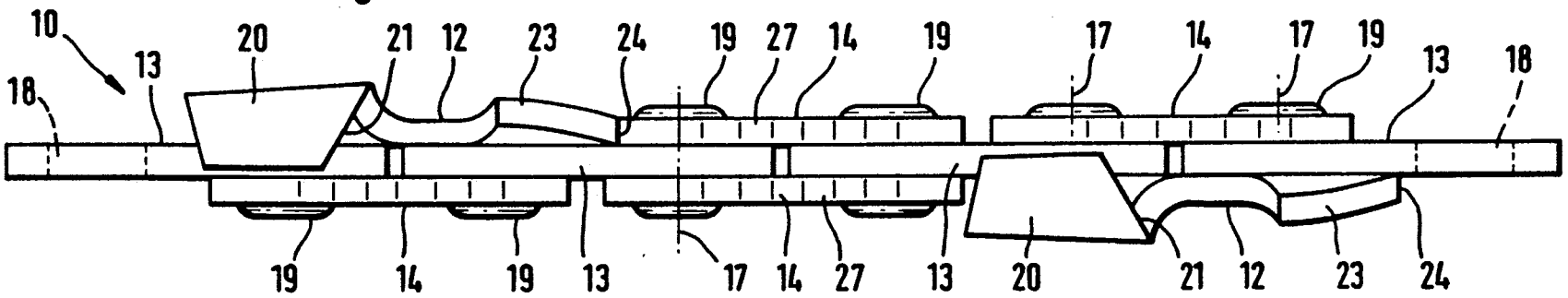
FIG. 9 is a plan view of the saw chain of FIG. 8.

In the embodiment of FIGS. 8 and 9, all side-connecting links 14 have rounded entrainers 33 arranged one behind the other on the edges 27 of these connecting links. The rounded entrainers 33 are arranged in a manner of wave crests running in the running direction U and are preferably configured so as to be uniform. It can be advantageous to configure the wave crests 35' similarly to the configuration of the entrainers 32' in FIG. 2 so that they increase in elevation in a direction opposite to the running direction U and/or are inclined in the running direction U.

It can also be advantageous to combine in a saw chain 10 drive links according to FIG. 6 having entrainers arranged in the manner of a saw-tooth configuration and side connecting links according to FIG. 6 having a profile defining a waveline.

Figure 10:
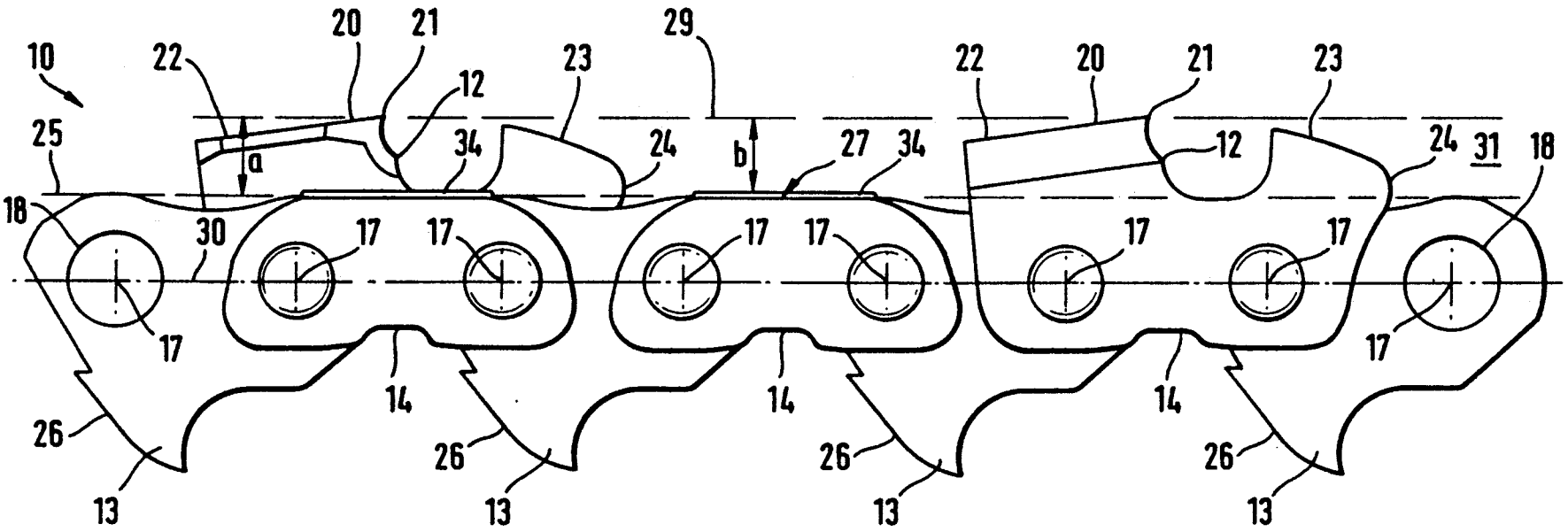
FIG. 10 is a cutaway portion of still another embodiment of the saw chain of the invention.

Likewise, it can be adequate to configure several or all of the edges 27 of the connecting links 14 and/or the edges 28 of the drive links 13 with a friction layer 34 as shown in FIG. 10. The friction layer 34 is provided either by a corresponding treatment of the edges 27 and 28 or formed by a coating. The friction layer has the function of an entrainer.

The entrainer is preferably produced as one piece with the chain link and is preferably produced by stamping.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a clear spacing (b) from said cutting plane for every operating position of said saw chain;

each of said some of said upper edges having a predetermined entire length measured in said running direction U;

said entraining means including a plurality of entrainers arranged one behind the other over a part length (B) of said entire length;

each one of said links corresponding to said several ones of said upper edges having two bores formed thereon for holding two of said rivets, respectively;

said two rivets defining respective pivot axes disposed in a common plane; and, said part length (B) being delimited by two lines tangent to said bores, respectively, and perpendicular to said common plane.

2. The saw chain of claim 1, each of said some of said upper edges having a predetermined entire length measured in said running direction U; and, said entraining means including a plurality of entrainers arranged one behind the other over said entire length.

3. The saw chain of claim 1, said plurality of entrainers being arranged in the manner of waves defining a wave crest.

4. The saw chain of claim 3, said waves defining a plurality of wave roots at the elevation of said upper edge.

5. The saw chain of claim 1, each of said entrainers being configured to have the same shape.

6. The saw chain of claim 1, said entrainers being configured so as to be coincident when placed side-by-side.

7. The saw chain of claim 1, said entrainers being configured so as to become increasingly higher in a direction opposite said running direction U.

8. The saw chain of claim 1, said entrainers being arranged in said running direction U.

9. The saw chain of claim 1, said entrainers having respective tips in the region of said limiting plane.

10. The saw chain of claim 1, each of said entrainers having a flank defining a flank plane and said flank plane and said common plane conjointly defining an angle.

11. The saw chain of claim 10, said angle being 45°.

12. The saw chain of claim 10, each of said entrainers having two flanks conjointly defining an angle of 90°.

13. The saw chain of claim 1, said entraining means being formed on all of said connecting links.

14. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a spacing (b) from said cutting plane for every operating position of said saw chain;

each of said some of said upper edges having a predetermined entire length measured in said running direction U;

said entraining means including a plurality of entrainers arranged one behind the other over a part length (B) of said entire length;

each one of said links corresponding to said several ones of said upper edges having two bores formed thereon for holding two of said rivets, respectively;

said two rivets defining respective pivot axes disposed in a common plane;

said part length (B) being delimited by two lines tangent to said bores, respectively, and perpendicular to said common plane;

said entrainers being arranged symmetrically with respect to a line drawn perpendicular to said common plane and passing through the center of said each one of said links; and, said entrainers being disposed symmetrically relative to said line drawn perpendicular to said common plane.

15. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a spacing (b) from said cutting plane for every operating position of said saw chain;

each of said some of said upper edges having a predetermined entire length measured in said running direction U;

said entraining means including a plurality of entrainers arranged one behind the other over a part length (B) of said entire length; and, said plurality of entrainers being a plurality of saw teeth arranged one behind the other and having respective pointed tips.

16. The saw chain of claim 15, said saw teeth defining a plurality of tooth roots at the elevation of said upper edge.

17. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a spacing (b) from said cutting plane for every operating position of said saw chain;

each of said some of said upper edges having a predetermined entire length measured in said running direction U;

said entraining means including a plurality of entrainers arranged one behind the other over a part length (B) of said entire length;

each one of said links corresponding to said several ones of said some of said upper edges having two bores formed therein for holding two of said rivets, respectively;

said two rivets defining respective pivot axes disposed in a common plane;

each of sad entrainers having a flank defining a flank plane and said flank plane and said common plane conjointly defining an angle;

one of said entrainers being symmetrically divided by a line perpendicular to said common plane and equidistant from said pivot axes; and said one entrainer having flanks from which imaginary lines can be extended to intersect said pivot axes, respectively.

18. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a spacing (b) from said cutting plane for every operating position of said saw chain;

a portion of said connecting links on one side of the saw chain being opposite corresponding ones of a portion of said cutting links on the other side of the saw chain; and, said entraining means also being formed on each one of said portions of said connecting links.

19. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a spacing (b) from said cutting plane for every operating position of said saw chain;

two of said connecting links lying between each two cutting links disposed one behind the other; and, said entraining means being formed on each of said two connecting links.

20. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a spacing (b) from said cutting plane for every operating position of said saw chain;

one of said drive links being disposed forward of each cutting link; and, said entraining means also being formed on each of said one drive links.

21. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding cut chips in said free space as said saw chain moves through the kerf;

said entraining means being at a spacing (b) from said cutting plane for every operating position of said saw chain; and, said entraining means also being formed on all of said drive links.

22. A saw chain for a motor-driven chain saw equipped with a guide bar and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf having a base;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

a substantially planar friction layer formed on at least several ones of said some of said upper edges for friction engaging and holding cut chips in said free space as said saw chain moves through the kerf; and, said friction layer being at a spacing (b) from said cutting plane for every operating position of said saw chain with said spacing (b) being only slightly less than said spacing (a) so as to cause said friction layer to always lie clear of the base of the kerf during the movement of the saw chain therethrough.

23. A saw chain for a motor-driven chain saw equipped with a guide bar having a nose portion and a drive motor for imparting a force to the saw chain for moving the latter around the guide bar in a predetermined running direction U, the saw chain comprising:

a plurality of side cutting links, a plurality of center driving links and a plurality of side connecting links, the links being pivotally interconnected by rivets to define the saw chain;

said rivets lying transversely to said running direction U;

each of said cutting links having a cutting tooth extending above said connecting links and said drive links for cutting a kerf having a base;

said cutting tooth having a cutting edge disposed above the saw chain and lying transversely to said running direction U;

the cutting edges of corresponding ones of said cutting links disposed one behind the other conjointly defining a cutting plane;

said drive links and said connecting links having upper edges facing toward said cutting plane;

at least some of said upper edges defining a limiting plane at a spacing (a) below said cutting plane;

said cutting plane and said limiting plane conjointly defining a free space for receiving and transporting cut chips from the kerf;

entraining means formed on at least several ones of said some of said upper edges for engaging and holding the cut chips in said free space as said saw chain moves through the kerf;

said entraining means being at a clear spacing (b) from said cutting plane for every operating position of said saw chain with said spacing (b) being only slightly less than said spacing (a) so as to cause said entraining means to always lie clear of the base of the kerf during the movement of the saw chain therethrough;

each of said some of said upper edges having a predetermined entire length measured in said running direction U;

said entraining means being arranged only over a part length (B) of said entire length so as to substantially maintain said spacing (b) also as said saw chain passes over said nose portion of said guide bar;

each one of said links corresponding to said several ones of said upper edges having two bores formed thereon for holding two of said rivets, respectively;

said two rivets defining respective pivot axes disposed in a common plane; and, said part length (B) being delimited by two lines tangent to said bores, respectively, and perpendicular to said common plane.

* * * * *